US009732541B2

(12) United States Patent
Hoovler

(10) Patent No.: US 9,732,541 B2
(45) Date of Patent: Aug. 15, 2017

(54) T-POST PULLER

(71) Applicant: Hoovler Innovations, LLC, Crystal Springs, MS (US)

(72) Inventor: Jeffrey Alan Hoovler, Crystal Springs, MS (US)

(73) Assignee: Hoovler Innovations, LLC, Crystal Springs, MS (US)

( * ) Notice: Subject to any disclaimer, the term of this patent is extended or adjusted under 35 U.S.C. 154(b) by 0 days.

(21) Appl. No.: 15/010,907

(22) Filed: Jan. 29, 2016

(65) Prior Publication Data

US 2016/0222695 A1 Aug. 4, 2016

Related U.S. Application Data

(60) Provisional application No. 62/110,581, filed on Feb. 1, 2015.

(51) Int. Cl.
*E04H 17/26* (2006.01)

(52) U.S. Cl.
CPC ..... *E04H 17/265* (2013.01)

(58) Field of Classification Search
CPC ..... E04H 17/265; E02D 9/02; E01F 9/011
USPC ..... 254/30
See application file for complete search history.

(56) References Cited

U.S. PATENT DOCUMENTS 2,303,312 A * 11/1942 Sheffield ..... B66F 1/02 188/67
2,482,950 A * 9/1949 Toftey ..... E04H 17/265 254/132
3,048,368 A * 8/1962 Linabery, Sr. ..... E04H 17/265 254/130
4,040,601 A * 8/1977 Boardman ..... B66F 19/00 254/133 R
4,422,621 A * 12/1983 Ekern ..... E04H 17/265 254/30
D312,196 S 11/1990 Norona
5,042,591 A 8/1991 Hull
5,242,152 A * 9/1993 Schatz ..... E04H 17/265 254/30
5,261,642 A * 11/1993 Stambaugh ..... E04H 17/265 254/30
6,056,271 A * 5/2000 Riojas ..... E04H 17/265 254/29 R
6,095,498 A * 8/2000 Lemoine ..... B25B 27/026 254/30
6,857,619 B1 * 2/2005 Jangula ..... E02F 3/96 254/132
7,059,587 B1 * 6/2006 Fimple ..... E04H 17/265 254/133 R
7,290,754 B2 11/2007 Mensi et al.
(Continued)

*Primary Examiner* — George Nguyen
(74) *Attorney, Agent, or Firm* — Nixon & Vanderhye P.C.

(57) ABSTRACT

A fence post removal device is provided which provides a simple mechanical device to allow a person to remove a fence post from an installed position within the ground. The device allows the person to sit atop a machine like a tractor or front loader, position the device over an exposed end of the fence post, and lower the device such that an internal guide causes the device to self-align with the top of a fence post which passes through the device a specific distance before coming into contact with a bumper which prevents the device from dropping too close to the ground.

20 Claims, 9 Drawing Sheets

(56) References Cited

U.S. PATENT DOCUMENTS

| | | | | |
|---|---|---|---|---|
| 7,963,051 | B2 * | 6/2011 | Ford | B66C 1/16 254/30 |
| 8,166,676 | B2 | 5/2012 | Ford | |
| 8,375,606 | B2 | 2/2013 | Ford | |
| 8,465,004 | B1 * | 6/2013 | Fly | B25B 27/02 111/95 |
| 8,608,132 | B1 * | 12/2013 | Allen | E04H 17/26 254/130 |
| 2007/0018144 | A1 * | 1/2007 | Saavedra | E04H 17/265 254/30 |
| 2007/0090332 | A1 * | 4/2007 | Mensi | E04H 17/265 254/30 |

* cited by examiner

T-POST PULLER

CROSS-REFERENCE TO RELATED APPLICATIONS

This application claims priority to provisional application 62/110,581, filed Feb. 1, 2015. The contents of that application are incorporated fully herein by reference.

BACKGROUND OF THE INVENTION

The application relates to fence post removal devices. Removing posts, such as steel posts, may be a physically difficult job that can require multiple persons, and/or may result in physical harm to the person or persons trying to remove the post from the ground. Fence posts may be placed in a variety of locations to demarcate property, lines or to section off property for various uses, such as for farming or horse or livestock pens.

Fence posts may conic in a variety of shapes, sizes, and configurations. One particular model of fence post is the T-post. In addition to their generally T-shaped cross-section, T-posts have a row of studs projecting from a flat side of a crossbar. The projections allow for attaching and aligning fencing such as wire fencing. T-posts are designed to have a cross-sectional shape like a letter T. T-posts have become popular because they are relatively low cost and easy to install quickly.

In placing fence posts, holes may be dug in the ground in which fence posts are placed with concrete or other foundational materials, or driven into the ground with hammers or other concussive devices. If the posts need to be removed for any reason, a significant amount of force may be required to lift the post from the ground. Ground which may have been tilled or otherwise softened for installation may have hardened. The locations where fence posts are installed may include locations which may become covered in a variety of vegetation and/or habitats for local animals, including spiny or thorned plants and venomous creatures.

Such removal can be physically demanding and may lead to exhaustion, muscle fatigue, abrasions, lacerations, and poisonous or benign animal bites. In other words, removal of fence posts may be hazardous for a variety of reasons. Additionally, multiple people may be required to remove each fence post using conventional devices.

BRIEF SUMMARY OF THE INVENTION

To address problems encountered by persons seeking to remove a fence post, and in particular a T-post, the present application provides a device for removing the fence post from an installed location, whereby the fence post is installed such that at least a portion of the fence is buried under the surface of the ground and may also be within concrete or other foundation material In particular, the present technology relates to a fence post removal device comprising a housing including a first end with a first opening, a second end with a second opening, and central passageway connecting the first opening to the second opening, the central passageway defining a longitudinal axis and the housing being configured to receive a fence post and allow the fence post to emerge at least partially from the second opening, an attachment element attached to the housing and configured to be attached to an external force providing device to transfer a force from the external force providing device through the housing and to the fence post; and a fence post engagement mechanism rotationally attached to the fence post removal device and configured to engage with the fence post, the engagement mechanism being unbiased and rotationally limited to prevent movement beyond a predetermined angle relative to the longitudinal axis; wherein the fence post engagement mechanism is configured to (a) move upwardly as the fence post moves upwardly through the central passageway and (b) drop into a locking arrangement with the fence post due to the fence post engagement mechanism fitting in a complementary manner.

DETAILED DESCRIPTION OF THE INVENTION

Figure 1:
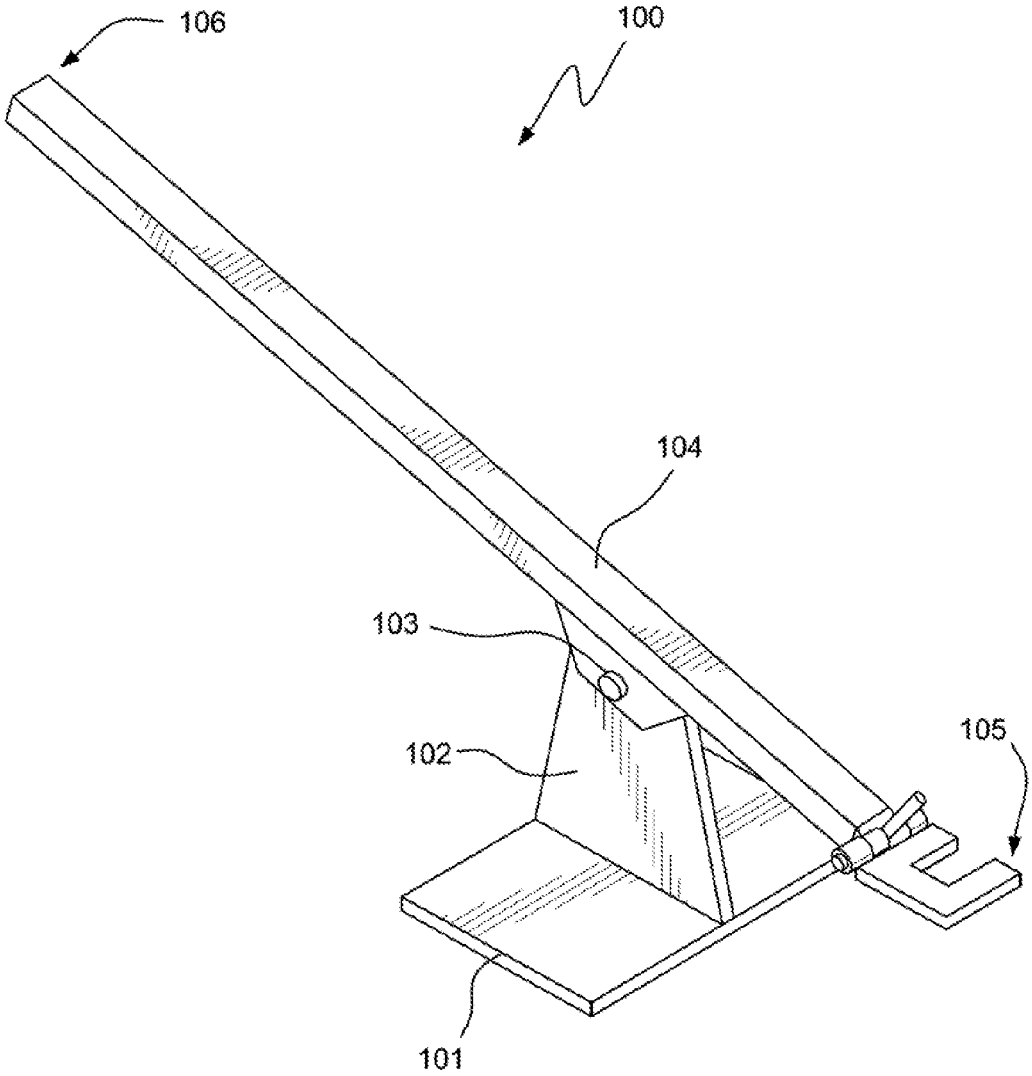
FIG. 1 (PRIOR ART)
FIG. 1 illustrates a manual fence post puller.

FIG. 1 illustrates a conventional post removal system 100. The conventional post removal system includes a base 101 which is placed on the ground near to an installed fence post. Upright 102 projects upwardly perpendicularly to the orientation of base 101. At the top of upright 102, a hinge 103 connects upright 102 with crossbar 104. A first end 105 of crossbar 104 is configured to engage the fence post at its base close to the ground and a second end 106 of crossbar 104 is configured to have a user push downwards thereupon. Due to a lever action around the hinge 103, the first end lifts upwards and pulls a buried section of the installed fence post out of the ground.

Figure 2A:
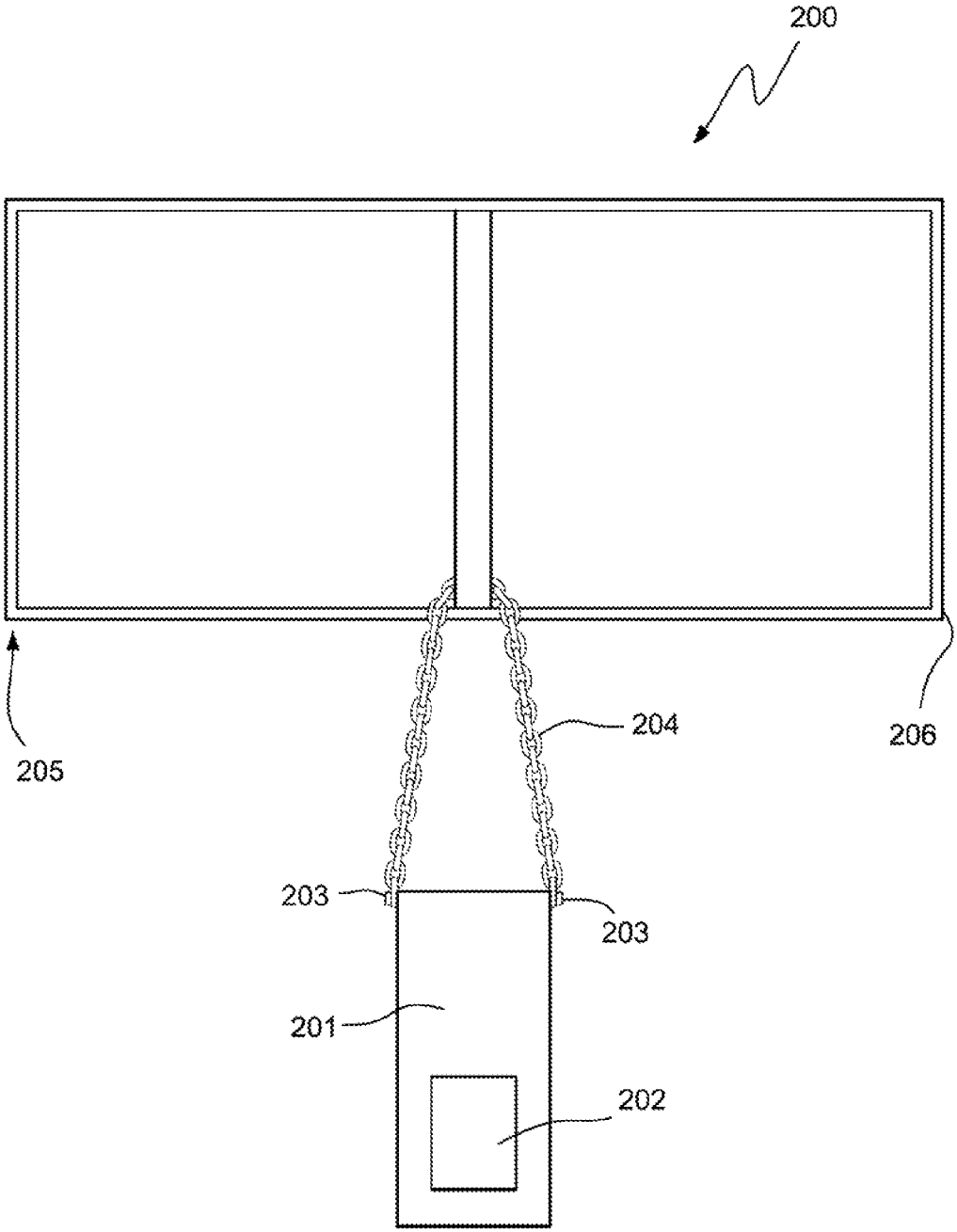
FIG. 2A (PRIOR ART)
FIG. 2A illustrates a fence post puller which may be attached to a tractor.

FIG. 2A illustrates a second conventional post removal system 200 which requires the use of a machine 205, such as a backhoe or tractor. The second system relies upon a housing 201 with an aperture 202 and attachment points 203 to which a flexible connection device 204 may be attached. The connection device 204 must be attached to the machine 205 to operate the system.

Figure 2B:
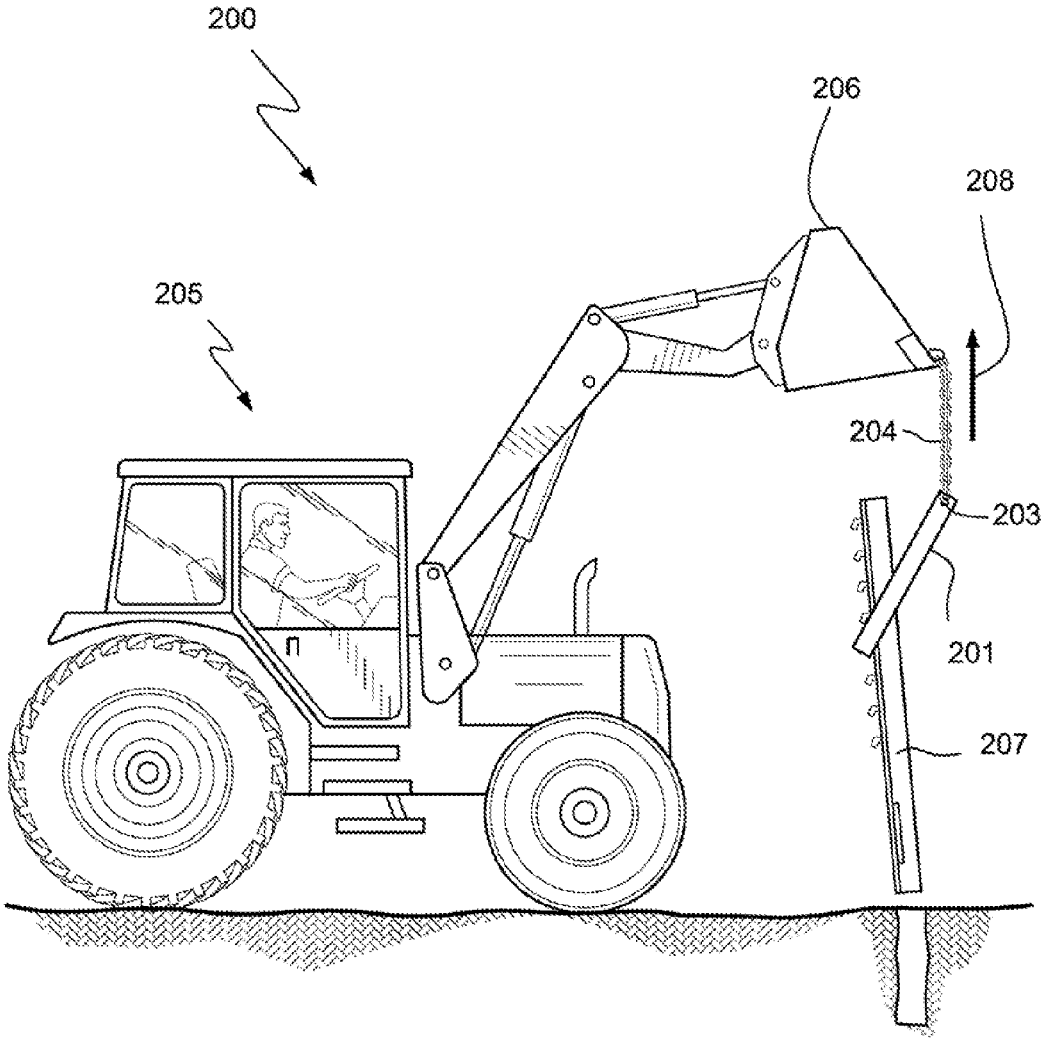
FIG. 2B (PRIOR ART)
FIG. 2B illustrates the fence post puller according to FIG. 2A attached to a tractor.

FIG. 2B illustrates the second conventional post removal system 200 during operation. The connection device 204 is attached to the machine 205 at a liftable part 206, like a front scoop on a front loader. The aperture 202 is placed around a standing fence post 207 so that the housing 201 drops around the fence post. The housing is moved forward to engage a protrusion from the fence post 207. This movement may be done by driving the machine forward or manually. The device 201 is then pulled upward 208 by the machine 205. The housing is placed manually onto the fence post or placed onto the fence post 207 by moving the machine 205 to drag the housing 201 across the fence post 207 such that the aperture 202 passes over the top of the fence post 207 and drops downward. The machine 205 has to be started and driven forward to engage the device 201 with the fence post 207 in addition to operating the machine's lifting mechanisms to pull the fence post 207 from the ground.

Figure 3:
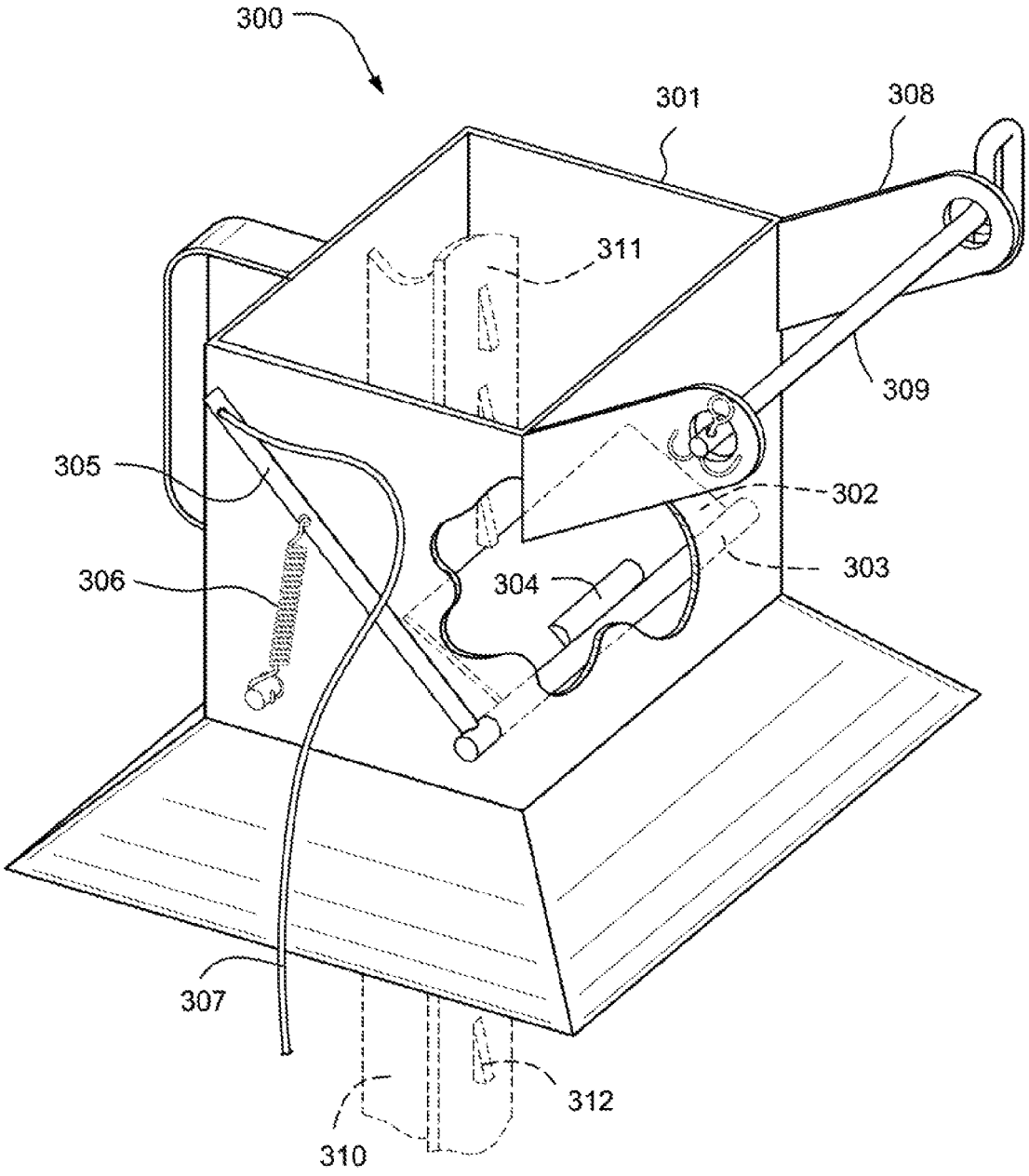
FIG. 3 (PRIOR ART)
FIG. 3 illustrates a manual fence post puller which may be attached to a tractor.

FIG. 3 illustrates a third conventional post removal system 300. In this system, a hollow rectangular body 301 is includes a ratchet plate 302 that rotates around a crossbar 303. The ratchet plate 302 includes a weight 304 placed on the ratchet plate 302 to force it downwards. Additionally, system 300 includes a sidebar 305 attached to the ratchet plate 302 and biased downwards by a spring 306. Sidebar 305 acts as a release device via string 307. Arms 308 project outwardly and allow attachment to a tractor by a transverse attachment bar 309 connected to a digger boom on the back of the tractor. The body 301 and tractor must be aligned correctly with fence post 310 for the device 300 to engage with projections from the fence post 310. Being aligned correctly means that the front face 311 of the fence post 310 is arranged parallel to the edge of ratchet plate 302 such that the projections 312 project perpendicular to the edge of the ratchet plate 302.

Figure 4A:
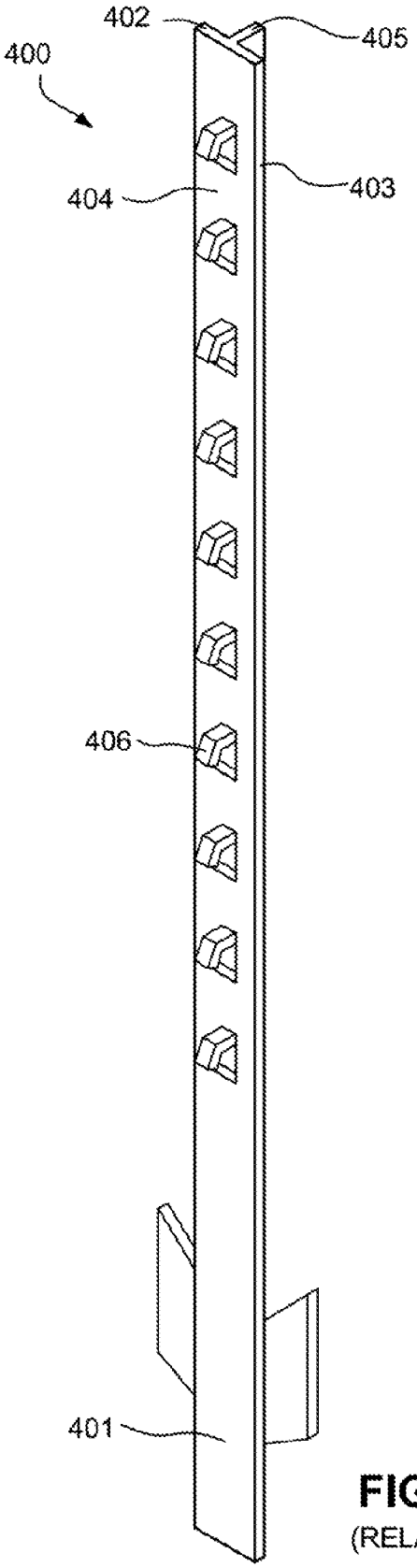
FIG. 4A (RELATED ART)
FIG. 4A illustrates a fence post in the form of a T-post.

FIG. 4A illustrates an exemplary fence post in the form of a T-post 400. The fence post has a body 401 with a first lateral rib 402 and a second lateral rib 403 projecting opposite to the first lateral rib 402, the first and second lateral ribs defining a front face 404. The body 401 also includes a top rib 405 projecting perpendicular to a plane defined by the lateral ribs 402, 403 and corresponding to front face 404. Lateral ribs 402, 403, and top rib 405 run the longitudinal length of body 401. The body 4011 also includes a number of protrusions 406 projecting periodically in a direction opposite to the top rib 405. Protrusions 406 are spaced to protrude at a regular distance from each other and are used to help secure wire, either directly or via a fastening mechanism, to the T-post.

Figure 4B:
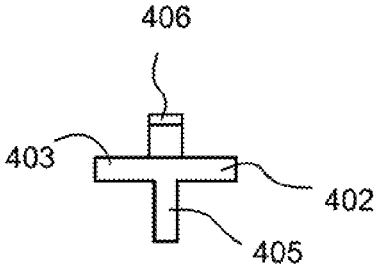
FIG. 4B (RELATED ART)
FIG. 4B illustrates a cross-section of FIG. 4A.

FIG. 4B illustrates a cross-section of a T-post.

Figure 5A:
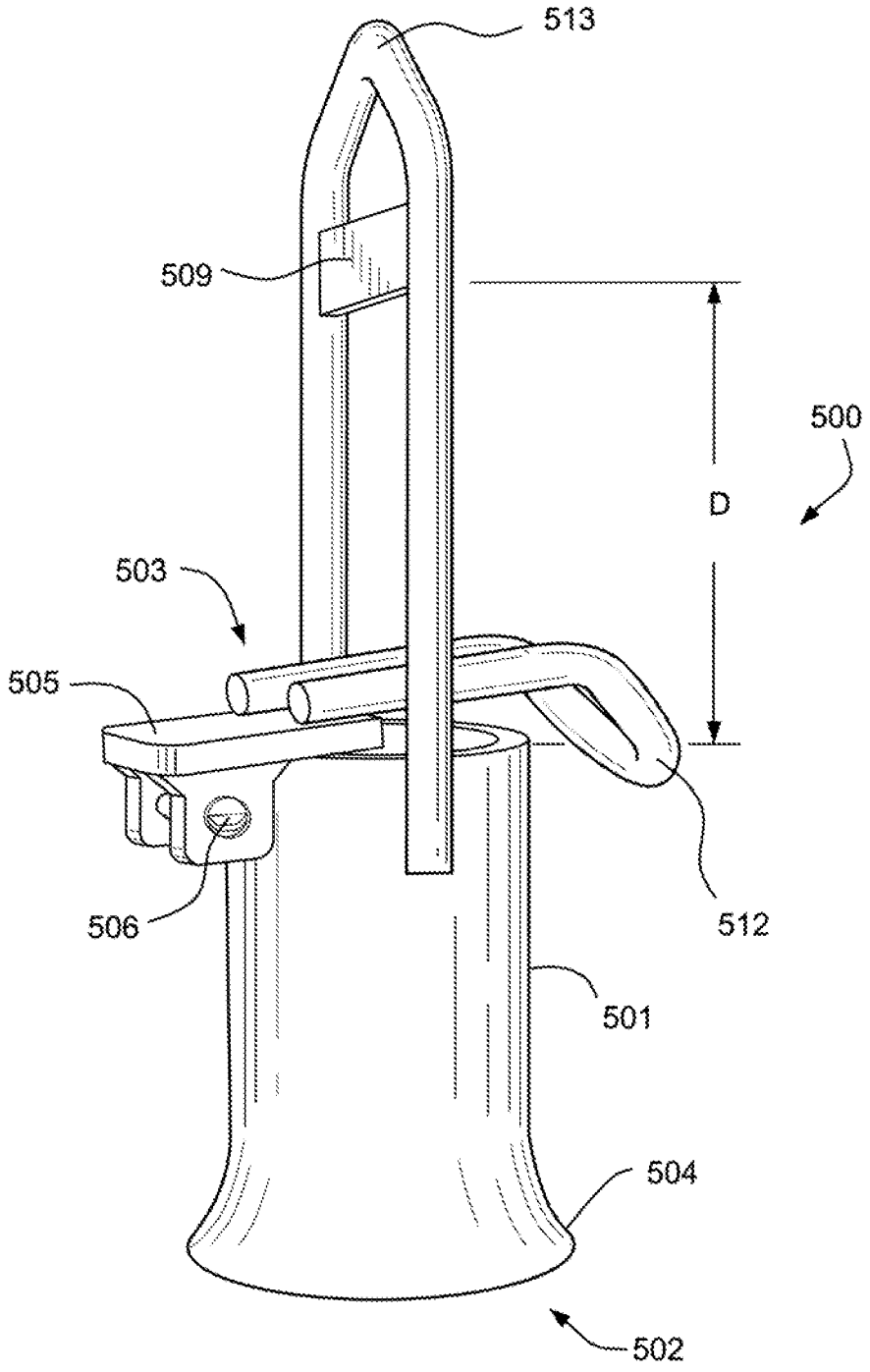
FIG. 5A illustrates a fence post puller.

FIGS. 5A-5D illustrate an exemplary configuration of the present technology. The fence post removal device 500 includes a body 501 with a first end 502 and a second end 503. The first end 502 has a shroud 504 projecting outward at a predetermined angle. The shroud 504 may be shaped to mirror the shape of the housing 501. The outward projection of the shroud may be linear or curved. In FIG. 5A, the housing 501 and shroud 504 are illustrated in an annular arrangement, with the shroud having a greater diameter than the housing. A lid 505 functions as a fence post engagement mechanism and is attached to the second end 503 of the housing via connection 506. The connection 506 is illustrated as a hinge. The lid 505 optionally may have a handle 512 attached to assist with lifting the lid. The handle may be configured as illustrated or in any way which allows adequate force to be applied to lift the fence post engagement mechanism to disengage from a fence post. The handle 512 may be made from a forged bar with a bend and two ends attached spaced apart on top of the lid 505. The two ends may be spaced far enough apart that the fence post passes between them as the fence post passes through the device 500.

Figure 5B:
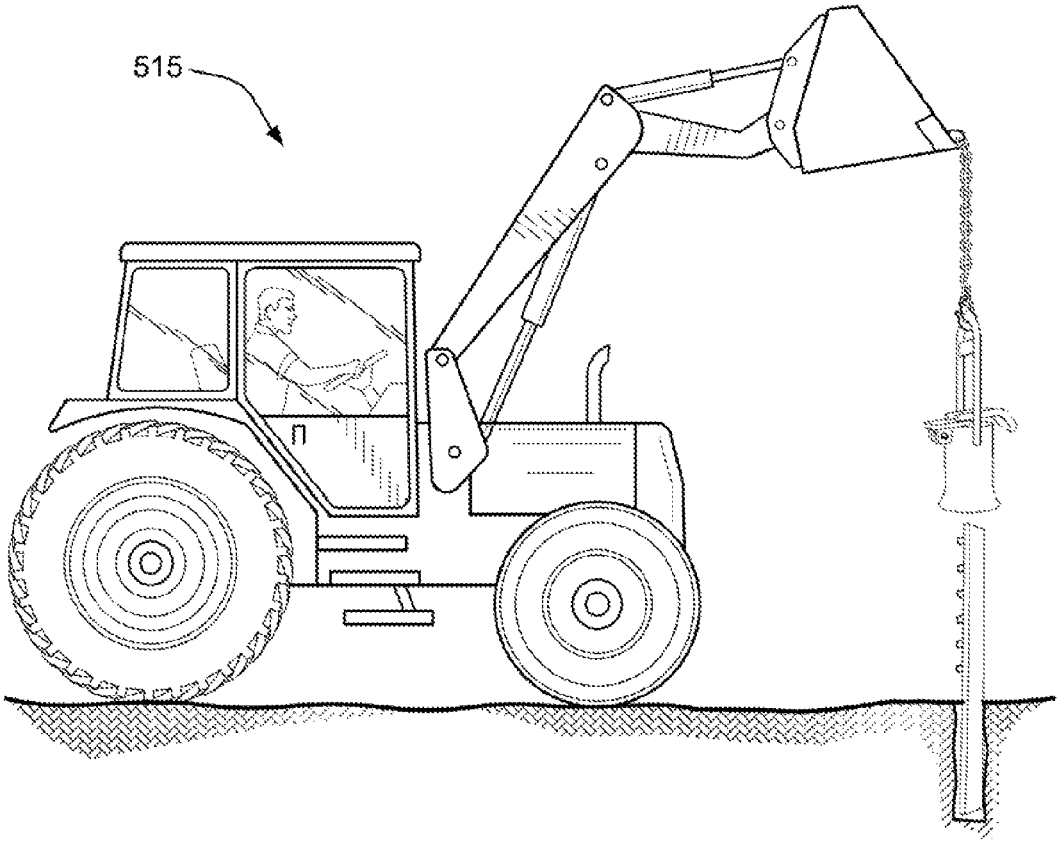
FIG. 5B illustrates the fence post puller of FIG. 5A in use.

The device 500 may be attached to a machine 515 like a tractor or front loader via a chain or similar device so the device hangs lively from the machine, as illustrated in FIG. 5B. Due to the shroud 504, the device may be lowered over the top of an exposed end of an installed fence post. As long as any part, of shroud 504 is located over the top of the fence post, lowering the device will cause the device to capture the fence post and direct it towards a central passageway 507 going through the body 501, the central passageway defining a longitudinal axis of the device. The central passageway 507 is best illustrated in FIG. 5C, which is a longitudinal cross section of the device 500.

As the body 501 of the device is lowered over the fence post, an internal guide 508 may cause the device to move and/or rotate and self-align the device 500 with the top of the fence post. Internal guide 508 may include a conical shape or opposed plates arranged at angles relative to the longitudinal axis of the device. The central passageway 507 may be shaped complementary to the shape a the fence post. In the case of a T-post, the cross-sectional shape of the central passageway may be similar to a lower case "t" as is the cross-sectional shape of a T-post, as illustrated in FIG. 4B. The combination of the internal guide 508 and the central passageway 507 having a complementary shape allows the device 500 to approach the fence post from a range of angles and still correctly engage the post due to the self-aligning design of the device 500.

Figure 5C:
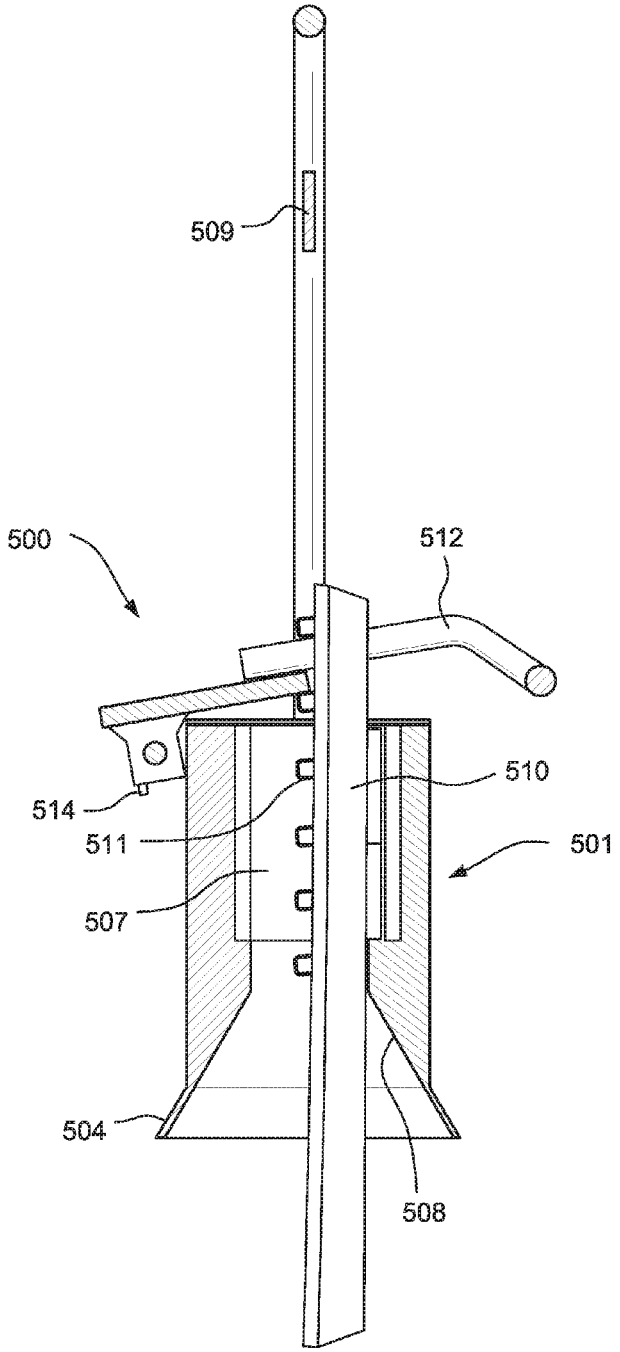
FIG. 5C illustrates a cross-sectional view of FIG. 5A along a longitudinal axis.
Figure 5D:
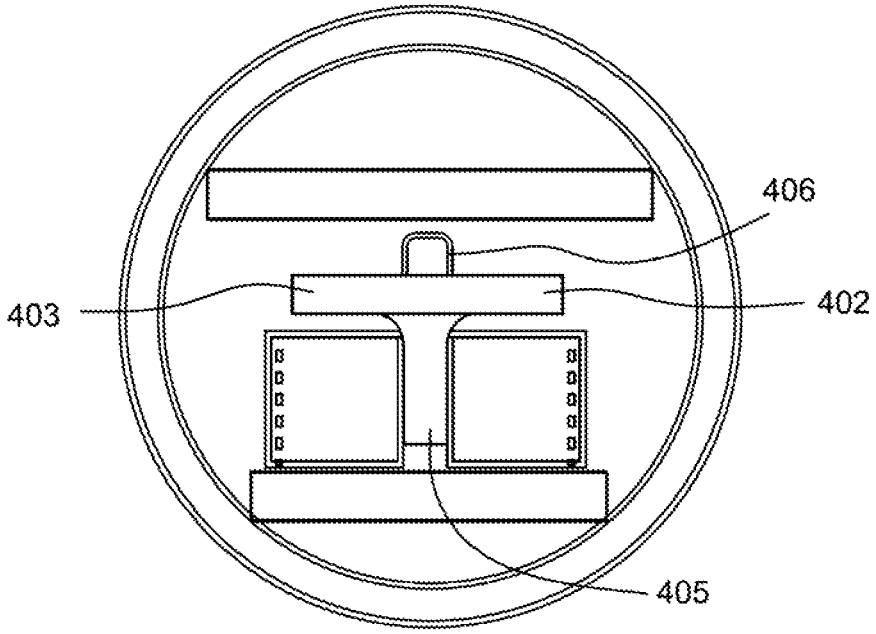
FIG. 5D illustrates a cross-sectional view of FIG. 5A transverse to the longitudinal axis.

Lid 505 is configured to engage the protrusions 511 of the T-post, as best illustrated in FIG. 5C. As the fence post 510 passes through the body 501 via central passageway 507, the fence post protrusions 511 pass the lid 505 and allow the lid to lockingly engage the post after a protrusion has passed the lid. The fence post may continue to pass through the body 501 until the top of the fence post abuts a transverse bumper 509 arranged at a distance from the second end 503 of the body. The bumper 509 may be oriented perpendicular to a central passageway 507 passing through the body along the axis of the body. The bumper 509 may be arranged such that the top of the fence post will abut the bumper or such that the top-most protrusion will abut the bumper when the fence post passes through the housing 501. A stop 514 may be provided to prevent the fence post engagement mechanism 812 from rotating beyond a predetermined angle As best illustrated in FIG. 5D, the central passageway 507 may be complementary to the shape of the fence post passing though the body 501. FIG. 5D illustrates the housing 501 in cross section across the body transverse to the longitudinal axis of the device. In FIG. 5D, the fence post is labeled with the same labels as those found in FIGS. 4A-B for simplicity.

The bumper 509 may be attached to the body 501 offset axially at a predetermined distance D, as seen in FIG. 5A, from the second end 503 of the body 501. The bumper may be incorporated into an upright handle 513 as illustrated in FIGS. 5A-B or may be a separate device. The upright handle 513 may allow the device to be easily carried and transported. The upright handle 513 may also serve as or incorporate a separate attachment point to which a cable, chain, rope, or other similar device may be attached to allow the device 500 to be suspended from the machine.

The bumper may also be arranged at a predetermined distance from the lid 505, which corresponds to a distance the fence post may project from the second end 503 of the body so that the lid 505 will be arranged between two consecutive protrusions from the fence post when the top of the fence post reaches bumper 509 and the lid is in a closed position. Preferably, the distance will be such that when the fence post has passed through the central passageway and abuts the bumper 509, the lid 505 will not abut the bottom of a protrusion which has just passed the lid (such that the lid can be opened without striking the protrusion).

The bumper 509 is preferably arranged at a distance so that the fence post may pass through the body 501 a sufficient distance to allow the device 500 to capture the fence post and pull it upwards, but not allow the fence post to pass completely through the device 500, which could result in the device dropping all the way to the ground.

Dropping the device all the way to the ground may require the operator to dismount from the machine to retrieve the device from the ground. The bumper 509 preferably ensures that the fence post passes sufficiently through the device while being set at a distance that the fence post engagement mechanism (e.g., lid 505) is arranged between consecutive protrusions when the top of the fence post abuts the bumper. Such a bumper arrangement enables release mechanism 512 to lift the lid and release the fence post. The bumper and release mechanism 512, illustrated as a handle, ensure that the release mechanism may be simple. The release mechanism 512 may alternatively or additionally be a rope, chain, or any other device which lifts the lid 505 after the fence post has been removed from the ground. The release mechanism 512 may be accessible from the machine such that the user may release a removed fence post from a position on the machine 515 without having to dismount to actuate the device 500.

The engagement mechanism (lid 505) may also feature an additional and/or separate engagement tool (not illustrated) configured to engage with the fence post as it passes through the body 501. The engagement tool may engage with a recess in or a projection from a fence such that the engagement mechanism 505 and/or engagement tool and fence post may enter a locked arrangement. The engagement tool may be an edge of the lid 505. The edge of the lid 505 may lift as the fence post 510 moves upwardly through the body 501 due to a top of a protrusion 513 pushing the bottom of lid 505 as the fence post 510 moves upwards. After the lid 505 is raised a sufficient distance, the angle of the lid 505 allows the lid 505 to slide past the protrusion 511 and drop back down to a position approximately transverse to the longitudinal axis of the body and below the protrusion 511.

With the protrusion 511 above the lid 505, the machine 515 or other force providing device may lilt upwardly and the protrusion 511 again contacts the lid 505, but in this situation, the top of the lid 505 abuts the bottom of the protrusion 511. In this position, the lid 505 abuts the upper end of body 501 at its second end 503. The upward force provided by the machine 515 causes the fence post 510 to move upwardly with the fence post removal device 500.

Once the fence post has been removed from within the ground and hangs freely from the machine, an operator may then release the fence post 510 from engagement with the removal device 500 without having to get off of the machine. To release the fence post, the operator may utilize a release mechanism 511 provided on the fence post removal device 500.

The engagement mechanism 505 is preferably freely rotatable and/or unbiased with freedom of movement around connection 506. In the configuration illustrated, the hinge 506 allows the lid 505 to move up and down freely without any additional parts such as springs biasing the engagement mechanism. The device is able to use gravity both to lower the device onto a fence post and to engage the device with the fence post without requiring additional parts or force-providing elements. Without any spring or similar extra biasing mechanism, the lower cost, ease of manufacturing, and improved reliability may be achieved. Similarly, once the fence post has been pulled from the ground, the device advantageously allows a simple mechanism operated remotely to release the fence post from the device, taking advantage again of gravity to separate the device from the removed fence post.

While the present technology has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A fence post removal device, comprising:

a housing including a first end with a first opening, a second end with a second opening, and central passageway connecting the first opening to the second opening, the central passageway defining a longitudinal axis and the housing being configured to receive a fence post and allow the fence post to emerge at least partially from the second opening;

an attachment element attached to the housing and configured to be attached to an external force providing device to transfer a force from the external force providing device through the housing and to the fence post; and a fence post engagement mechanism rotationally attached to the fence post removal device and configured to engage with the fence post, the engagement mechanism being unbiased and rotationally limited to prevent movement beyond a predetermined angle relative to the longitudinal axis;

wherein the fence post engagement mechanism is configured to (a) move upwardly as the fence post moves upwardly through the central passageway and (b) move into a locking arrangement with the fence post after a protrusion on the fence post passes the fence post engagement mechanism.

2. The fence post removal device according to claim 1, further comprising a guide attached to and projecting from the first end of the housing and configured to direct the fence post into the first end of the housing.

3. The fence post removal device according to claim 1, further comprising an internal guide configured to align the fence post within the central passageway.

4. The fence post removal device according to claim 3, wherein the internal guide comprises a substantially conical shaped structure within the housing.

5. The fence post removal device according to claim 3, wherein the internal guide comprises a pair of opposing plates angled upwardly from the second end of the housing towards the central passageway.

6. The fence post removal device according to claim 3, wherein the central passageway is shaped complementary to the fence post.

7. The fence post removal device according to claim 1, further comprising a release mechanism configured to disengage the fence post from the fence post engagement tool.

8. The fence post removal device according to claim 7, wherein the fence post release mechanism is configured to be operated remotely.

9. The fence post removal device according to claim 1, wherein the fence post engagement mechanism is arranged on a lid attached to the housing.

10. The fence post removal device according to claim 1, wherein the fence post engagement mechanism comprises a flap or plate.

11. The fence post removal device according to claim 1, further comprising a stop configured to prevent the fence post engagement mechanism from rotating beyond a predetermined angle.

12. The fence post removal device according to claim 1, further comprising a stop configured to prevent the fence post from passing completely through the fence post removal device.

13. The fence post removal device according to claim 12, wherein the stop comprises a bumper arranged such that a first end of the fence post passing through the second opening will abut the bumper before the fence post passes entirely through the housing.

14. The fence post removal device according to claim 13, wherein the bumper is at a predetermined distance from the engagement mechanism, the predetermined distance being a distance the fence post must project from the housing such that the fence post engagement tool is between two consecutive projections projecting from the fence post.

15. The fence post removal device according to claim 1, wherein the fence post removal device is configured to remove a fence post which has a T-post configuration.

16. The fence post removal device according to claim 1, wherein the attachment element is configured to connect with a cable, chain, or rope.

17. A fence post removal system, comprising:

the fence post removal device according to claim 1;

a mechanized device; and a connecting element arranged between the fence post removal device and the mechanized device;

wherein the mechanized device provides pulling force to the fence post removal device via the connecting element.

18. The fence post removal system according to claim 17, wherein the fence post removal device is configured to self-align with the fence post being removed when the fence post removal device is lowered onto the fence post from above.

19. The fence post removal device according to claim 1, wherein the fence post engagement mechanism is attached to the fence post removal device by a hinge.

20. The fence post removal device according claim 1, wherein a bumper is arranged continuously with a handle projecting from the housing.

* * * * *